US006113979A

United States Patent [19]

Sagawa et al.

[11] Patent Number: 6,113,979

[45] Date of Patent: Sep. 5, 2000

[54] POWDER COATINGS AND METHODS FOR FORMING A COATING USING THE SAME

[75] Inventors: Masato Sagawa; Osamu Itatani, both of Kyoto; Akira Fujiwara, Shizuoka, all of Japan

[73] Assignees: Intermetallics Co., Ltd., Kyoto; Tomoegawa Paper Co., Ltd., Tokyo, both of Japan

[21] Appl. No.: 09/143,250

[22] Filed: Aug. 28, 1998

[30] Foreign Application Priority Data

Sep. 1, 1997 [JP] Japan ..... 9-251403

[51] Int. Cl.[7] ..... B05D 1/36

[52] U.S. Cl. ..... 427/201; 427/195; 427/202

[58] Field of Search ..... 427/195, 201, 427/202; 118/311

[56] References Cited

U.S. PATENT DOCUMENTS

| | | | |
|---|---|---|---|
| 3,028,251 | 4/1962 | Nagel | 117/21 |
| 3,440,076 | 4/1969 | Vaurio | 117/13 |
| 5,273,782 | 12/1993 | Sagawa et al. | 427/242 |
| 5,470,893 | 11/1995 | Sinclair-Day et al. | 523/205 |
| 5,474,803 | 12/1995 | Kikuchi | 427/180 |
| 5,505,990 | 4/1996 | Sagawa et al. | 427/184 |
| 5,714,206 | 2/1998 | Daly et al. | 427/495 |

OTHER PUBLICATIONS

Correll et al., serial number 08/643694, May 6, 1996.

*Primary Examiner*—Shrive Beck
*Assistant Examiner*—Jennifer Calcagni
*Attorney, Agent, or Firm*—Oblon, Spivak, McClelland, Maier & Neustadt, P.C.

[57] ABSTRACT

The powder coating of the present invention was used for a method for forming coatings comprising the steps of making the powder coating adhere to an adhesive layer previously formed on the surface of a material to be coated, and then heating it, thereby forming a coating, comprising a resin particle containing a thermosetting resin, and a particle containing a curing agent.

1 Claim, 1 Drawing Sheet

POWDER COATINGS AND METHODS FOR FORMING A COATING USING THE SAME

BACKGROUND OF THE INVENTION

The present invention relates to a powder coating used in a method for forming a coating on the surface of materials used in various fields, in particular, an insulating material, a material having low heat-resistance and to a method for forming a coating using the same.

This application is based on patent application No. Hei 09-251403 filed in Japan, the content of which is incorporated herein by reference.

In recent years, it is well known that a powder coating containing no organic solvents exerts very few bad influences over persons, and the global environments; therefore, it is extremely beneficial. Therefore, use of a powder coating in various fields in which a solvent coating is employed has been suggested.

An ordinary thermosetting powder coating comprises a thermosetting resin and a curing agent. A coating is formed by making the thermosetting powder coatings adhere to the surface of a material to be coated, and then heating it.

Specifically, the coating methods for making the thermosetting powder coatings adhere to the surface of a material to be coated which is ordinarily employed are as follows:

1. Flow Dip Coating

A material to be coated which is heated above the melting point of the powder coatings (usually approximately 300° C.) is made pass through a bath in which the powder coating particles flow by the force of an air flowing out from a madreporite. Thereby the powder coating particles instantaneously melt by heat radiated from the material to be coated, and adhere on the surface of the material.

2. Electrostatic Flow Dip Coating

A material to be coated fitted with a ground wire and passed through a bath in which the powder coating particles charged by the force of an air flowing out from a madreporite, and thereby, the powder coating particles are made to adhere to the surface of the material to be coated by electrical adhesion.

3. Electrostatic Spray Coating

Powder coating particles are charged inside a spray gun or an overhanging portion thereof, and are sprayed onto a material to be coated which is fitted with a ground wire, and thereby the powder coating particles adhere the surface of the material to be coated by the electrical adhesion.

A cured coating is obtained by making the powder coating adhere to the surface of the material to be coated by these coating methods; heating is carried out in a range of 140 to 200° C. for 20 to 60 minutes, and thereby crosslinking a thermosetting resin and a curing agent comprising the powder coatings.

However, the powder coatings adhere to the surface of the material to be coated by an adhesion or an electric adhesion of the melted powder coatings in these coating methods; therefore, these coating methods cannot be utilized for the materials having low heat resistance, and the insulating materials.

The thermosetting powder coatings used in these coating methods are produced by dry blending a thermosetting resin, a curing agent, and if necessary, an additive, melting and kneading at the temperature more than the flow-softening point of the thermosetting resin, cooling, and then crushing.

A latent curing agent which is stable at room temperature and can crosslink with a thermosetting resin at approximately 140 to 200° C., such as dicyandiamide, imidazolines, hydrazines, blocked isocyanates, acid anhydrides, and dibasic acids, is used for the conventional powder coatings produced by the above formation methods.

When the powder coatings are produced using a curing agent quickly are cured with a thermosetting resin at low temperature, for example, 120° C. or less in the above coating methods, a crosslinking reaction, that is, a curing reaction occurs, during the step of melting and kneading in a kneader, and the cured resin adheres to the groove formed at the shaft. Then, materials for powder coatings are slightly stirred by the kneader, and the viscosity of the kneaded materials becomes large because of the crosslinking. As a result, the amount discharged is small, and the productivity thereof becomes low. Moreover, the obtained kneaded materials are polymerized by the crosslinking reaction, so the hardness thereof is high; therefore, a crushing efficiency thereof becomes low. Therefore, when the powder coatings curing at low temperature are produced in the conventional manufacturing methods, the productivity thereof is low. The powder coatings curing at low temperature produced in the conventional manufacturing methods are unsuitable for industrial large-scale production. Moreover, the obtained powder coatings are polymerized by the crosslinking reaction during kneading, so the flow-softening point thereof is high; therefore, flowing properties during melting step are bad. As a result, a problem, such as the surface of the coating after heating being uneven, arises. In addition, the pot life of the obtained powder coatings is short, the crosslinking reaction between a thermosetting resin and a curing agent is proceeded at 25° C. or less; therefore, the problem arises that storage properties thereof is worse arises.

Therefore, a curing agent which has high reactivity, and is cured at low temperature cannot be used with the thermosetting powder coatings obtained by the above manufacturing methods. In general, a latent curing agent which can be crosslinked with a thermosetting resin at 140 to 200° C. is used to the thermosetting powder coatings obtained by the above manufacturing methods. Consequently, when a coating has to be formed by rapidly curing the powder coatings at 120° C. or less on the surface of the material to be coated comprising of a plastic or a raw material having a low heat resistance, such as electronic components, and electrical components, it is difficult to use a thermosetting powder coating.

As described above, the formation of a coating on the materials to be coated comprises of a plastic; an electronic component, an electrical component; an insulated raw material such as a glass, or a raw material having a low heat resistance, using powder coatings, has problems concerning coating, producing the powder coatings, and low storage properties of powder. When a coating is formed on these materials to be coated, a solvent spray coating using a solvent coating comprising a resin, a curing agent, an additive, and an organic solvent is employed.

SUMMARY OF THE INVENTION

It is therefore an object of the present invention to provide a powder coating which can solve these problems, that is, to provide a powder coating which is suitable for forming a coating on the surface of an insulating material, a raw material having a low heat-resistance, etc. which were coated by a solvent spray coating, and a method for forming a coating using the same.

According to one aspect of the present invention, there is provided a powder coating used for a method for forming a coatings comprising the steps of making the powder coating adhere to an adhesive layer previously formed on the surface of a material to be coated, and then heating, and thereby forming a coating, comprising a resin particle containing a thermosetting resin, and a particle comprising a curing agent.

According to another aspect of the present invention, there is provided a method for forming a coating comprising the steps of making the powder coating comprising resin particles and particles containing a curing agent adhere to an adhesive layer previously formed on the surface of a material to be coated, and heating it.

DETAILED DESCRIPTION OF THE PREFERRED EMBODIMENTS

Figure 1:
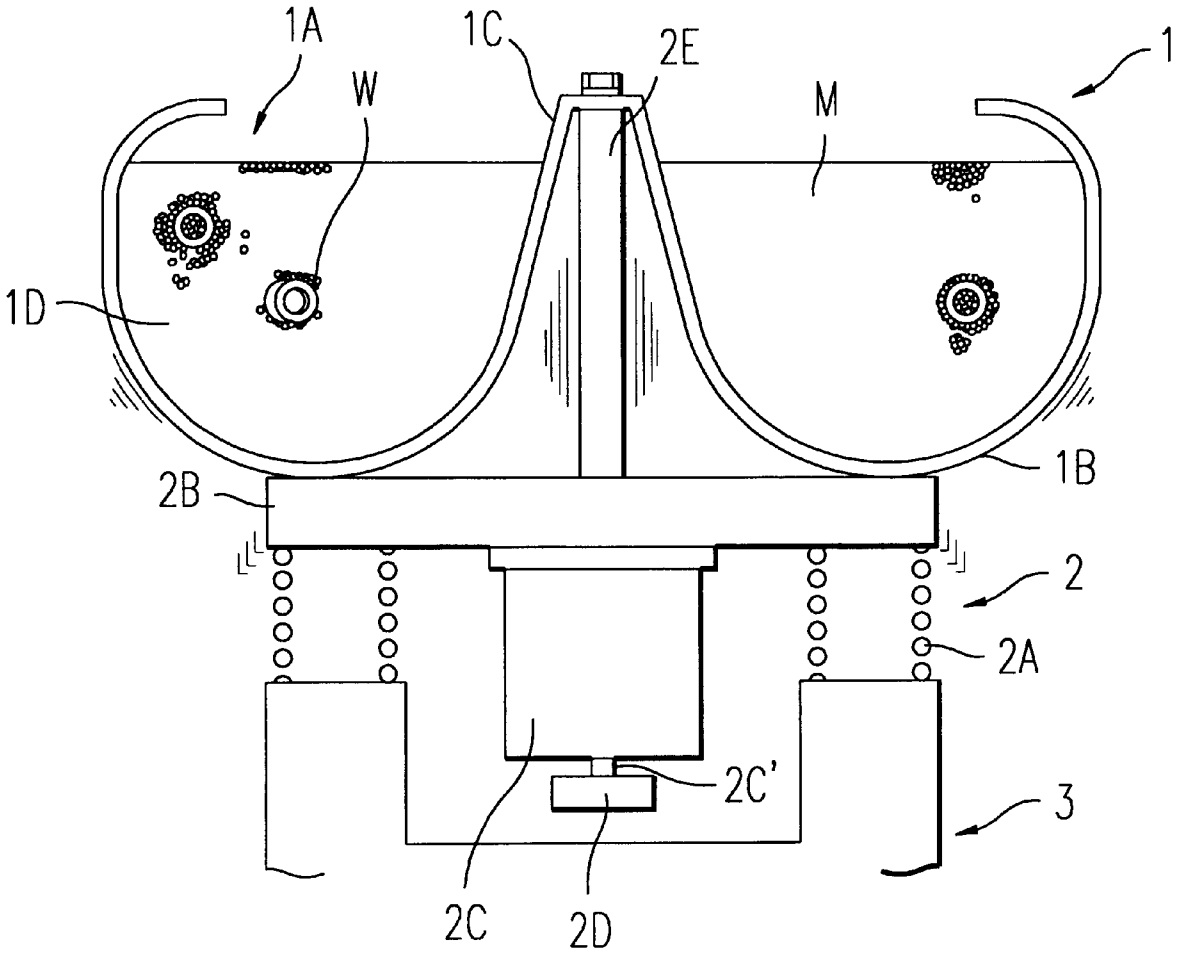
FIG. 1 shows one example of a coating forming device used to a method for forming a coating of the present invention.

The embodiments of a powder coating and a formation method for a coating using the same of the present invention will be explained. However, the present invention is not limited to the following embodiments.

The formation method of a coating using the powder coating of the present invention will be explained.

The present inventors found that the powder coating particles will uniformly adhere to the surface of an insulating material by previously forming an adhesive layer on the surface of the insulating material.

The adhesive layer can be formed by coating an adhesive on the surface of the material to be coated. When the material is comprised of plastics, the adhesive layer can also be formed by melting or swelling the surface of the material using an organic solvent.

The adhesives are preferred which have a good compatibility to the melted powder coatings when they are heated, and simultaneously have an adhesiveness to the materials to be coated. When the adhesives comprise a thermosetting resin having a functional group, it is suitable to add proper quantity of a curing agent having a functional group which can crosslink with the former the functional group.

Examples of the adhesive include not only typical resins in a non-cured liquid state or a semi-cured liquid state of epoxy resin, acrylic resins, polyester resins, phenol resins, but also amines, ethers, glycols, tars, and monomers, oligomers, or polymers of styrene, acryl, phenol, and isocyanate which are in a liquid state or a semi-liquid state. In particular, amines, amides, imidazoles, isocyanates, etc. which can crosslink at 120° C. or less with a curing agent comprising of a powder coating; adhesives containing a well-known curing agent in a liquid state commonly used in a solvent painting; epoxy resins, acrylic resins, etc. which can crosslink at 120° C. or less with a curing agent comprised of a powder coating; adhesives containing a well-known thermosetting resin in a liquid state which are commonly used in a solvent painting; epoxy resins, acrylic resins, and polyester resins which can crosslink at 120° C. or less; adhesives containing a well-known thermosetting resin in a liquid state which is commonly used in a solvent painting and a well-known curing agent in a liquid or solid state such as amines, amides, imidazoles, isocyanates; etc. These adhesives can sufficiently crosslink at lower temperatures, can produce a cured coating having excellent mechanical strength, and have good adhesiveness to a material to be coated; therefore, these adhesives are more preferable.

Moreover, if necessary, additives may be added to the adhesive. Examples of additives include, a coupling agent such as silane coupling; a foam inhibitor such as benzoin; a plasticizer such as acrylic oligomer; a pigment such as titanium oxide, carbon black, iron oxide, copper phthalocyanine, azo pigments, condensed polycyclic pigments; a metal powder such as aluminum powder, copper powder; a thickener such as silica, alumina; an antioxidant; a preservative; an antimicrobial agent; an accelerating agent; an active diluent; etc.

The adhesive layer can be formed on the surface of a material to be coated using above adhesives by dipping the material into the adhesive, spraying the adhesive on to the material, or coating the adhesive using a brush or a roller on the material. In forming the adhesive layer, when the viscosity of the adhesive used is high, if necessary, the adhesive can be diluted using ordinary diluent or industrial cleaning agents such as ethers, alcohols, ketones, aromatic compounds, etc. Cleaning the surface of the material to be coated and forming the adhesive layer are simultaneously proceeded by using a diluent or a cleaning agent having a high detergency. Therefore, it is preferable to use a diluent or a cleaning agent having a high detergency.

After forming the adhesive layer on the surface of the material to be coated in the above manner, the powder coatings comprising resin particles containing a thermosetting resin, and particles containing a curing agent are made adhere to the obtained adhesive layer.

Examples of the method for making the powder coatings adhere to the adhesive layer on the surface of the material to be coated include 1. spraying the powder particles to the surface of the material to be coated using a spray gun,
2. passing the material to be coated through a bath in which the powder coatings flow by the force of flowing air gushing out of a madreporite, and
3. pressure fitting or pressure contacting the powder coatings to the adhesive layer using the impact force of a vibration.

According to the methods of the items 1 and 2, the powder coatings adhere to the adhesive layer on the surface of the material to be coated using a transporter air or a flowing air. When the external force obtained from the air is insufficient, it is difficult to pressure fit or pressure contact the powder coatings to the adhesive layer, and therefore a only single layer comprising the powder coatings is formed on the surface of the adhesive layer. While a uniform coating can be obtained, it is difficult to obtain thick coatings.

The method for forming a coating disclosed in Japanese Patent Application, First Application No. Hei 5-302176 invented by the present inventors can be given as the method for the above item 3. Referring to FIG. 1, one method of forming a coating according to the item 3 will be simply explained.

Moreover, the adhesive layer formed at the surface of the material to be coated will do as so long as the powder coatings can adhere thereto. Therefore, the conditions of the surface of the adhesive layer may be adhesive or sticky or not.

In FIG. 1, reference symbol 1 denotes a container made of a hard material such as hard synthetic resin, metal, etc., and an opening portion 1*a* is formed at upper portion thereof. A ring-shape space 1*d* is formed around a cylindrical portion 1*c* by expanding the center portion of a bottom 1*b* approximately to the level of the opening portion 1*a,* thereby forming the cylindrical portion 1*c*.

Reference symbol 2 denotes an agitator equipped with a diaphragm 2*b* supported by several coil springs 2*a* arranged on a base 3. A motor 2*c* is suspended at the center bottom of the diaphragm 2*b*. A weight 2*d* is eccentrically provided on an output shaft 2*c'* of the motor 2*c* extending down. A vertical axel 2*e* is provided on the center bottom of the diaphragm 2*b*. Moreover, the upper portion of the cylindrical portion 1*c* of the container 1 is provided on the upper end of the vertical axis 2*e*. The eccentric weight 2*d* is rolled by rolling the motor 2*c*. Thereby, the container 1 is vibrated via the vertical axis 2*e* provided on the diaphragm 2*b*.

An impact medium (means for mediating a coating formation) in a particle shape comprising a rubber, a synthetic resin, or a ceramics, the flowing powder coatings, the material W to be coated formed the adhesive layer, and if necessary, a mixture M comprising a pigment, a plasticizer, and a foam inhibitor are put into the container 1. When the agitator 2 is driven, the particles comprising the powder coatings (called "coating particles" hereinbelow) adhere to the adhesive layer formed on the material W, via the media for forming a coating. These adhering coating particles are struck by the media, and firmly attach to or are absorbed into the adhesive layer, and thereby a coating particle layer is formed. When these adhering particles are repeatedly struck by the media, the adhesive is exuded out from the surface of the adhering coating particle layer. The further coating particles adhere to the pushed out adhesive, via the media for forming a coating. In this way, the formation of a coating on the surface of the material to be coated proceeds. In the case that the adhesive cannot be pushed out from the coating particle layer even when the coating particle layer is struck by the media for forming a coating, the formation of a coating is finished.

According to the method for forming a coating, the coating particles adhere to the material to be coated due to the adhesiveness of the adhesive and by an impact force of the media for forming the coating; therefore, the coating particles are in plural layers and simultaneously are densely filled in the coating particle layer. Therefore, the method for forming a coating has the effect that the thickness of the coating particle layer can be controlled by controlling the viscosity, adhesiveness, and the thickness of the adhesive layer.

Moreover, the coating particle layer can be formed by adding the coating particles in the container 1, vibrating the coating particles so as that the coating particles flow, and dipping the material to be coated and formed the adhesive layer into the container.

The coating particles themselves work as the media for forming a coating in this method not using the media for forming a coating. The impact force generated from the vibration transmits to the coating particles. Thereby, the coating particle layer can be formed by firmly attaching the coating particles to or absorbing the coating particles into the adhesive layer formed on the surface of the material to be coated. The adhering of the coating particles to the material proceeds as in the above formation method, when the coating particle layer is struck by the coating particles.

According to this method, when the powder coatings having low fluidity (that is, large cohesion) are used, the coating particles easily cohere to each other forming lumps on the material to be coated, and thereby a smoothness of the surface of the obtained coating easily becomes low. Therefore, it is preferable to use powder coating having a fluidity 0.40 or more in this method. Fluidity denotes the ratio between a bulk specific gravity and a true specific gravity (bulk specific gravity/true specific gravity). When the fluidity is larger, the cohesion only generated.

In order to control the fluidity of the powder coatings 0.40 or more, the flowing method can be given:

1. A volume average particle diameter of the coating particles is increased. It is preferable to restrict the average volume particle diameter of the coating particles 30 $\mu$m or less because of the following reasons.
2. The ratio of the coating particles having a small diameter is kept low by removing the coating particles having a small diameter using a classifier.
3. The shape of the powder coatings is made spherical.

Regarding the method 3, more detailed explanation will be below:

3-1 The shape of the resin particles obtained by dry mixing a raw material, melting and kneading using a kneader, and crushing using a crusher, is irregular. The irregular shape can be changed to a spherical are by using an external force such as heat, impact force, etc. If necessary, it is possible to treat a shape of the particles containing a curing agent so as make them spherical. However, when the resin particles and the curing agent particles are simultaneously treated, they are crosslinked; therefore, it is preferable to individually treat them, and individually dry mix them.

3-2 The coating particles in a globular shape can be obtained alone in a spray drying method, and a polymerizing method.

4. The surface of the coating particles are improved by making a material adhere which can provide fluidity, for example, an inorganic grain such as silica grain, alumina grain, etc.; a crosslinked resin grain such as methyl methacrylate, etc.; a metallic soap such as zinc stearate, etc.

The fluidity of the coating particles can be improved by these method alone, or combined together.

The bulk specific gravity is the value measured as stipulated in JIS K 5101.20.1, Still Standing method, and the true specific gravity is the value measured as stipulated in JIS K 0061.5.2, The pycnometer method.

In this method for forming a coating without using the media for forming a coating, the coating particles adhere in the same process as the aforementioned method for forming a coating using the media. Therefore, the coating particles are in plural layers and simultaneously are densely filled in the coating particle layer. Therefore, this method for forming a coating has the effect that the thickness of the coating particle layer can be controlled by controlling the viscosity, adhesiveness, and the thickness of the adhesive layer.

The cured coating can be obtained by making the powder coatings adhere to the material to be coated in these methods, heating at a certain temperature for certain periods, thereby crosslinking the functional group of the thermosetting resin with the functional group of the curing agent.

The "certain temperature" and the "certain periods" are suitably determined by the raw material comprising the coating particles, and the adhesive, and the material to be coated. In the present method for forming a coating, it is preferable that the certain temperature is in a range of 70 to 120° C., and the certain periods are in 10 to 120 minutes, more preferable that the certain temperature is in a range of 70 to 100° C., and the certain periods are in 30 to 120 minutes.

A powder coating of the present invention will be explained below.

The powder coatings of the present invention are thermosetting powder coatings and comprise a resin particle containing a thermosetting resin, and a particle containing a curing agent.

A well known thermosetting resin commonly used in the powder coatings such as epoxy resins, acrylic resins, phenol resins, polyester resins, etc. are used as the thermosetting resin. These thermosetting resins can be used alone, or combined together with two or more kinds. In particular, a thermosetting resin having an epoxy group (that is, glycidyl group), such as epoxy resins, acrylic resins, etc. are preferable, because these thermosetting resins have excellent reactivity to a curing agent comprising the curing particles even at low temperature, for example, 120° C. or less.

A well known latent curing agent such as dicyandiamide, imidazolines, hydrazines, acid anhydrides, blocked isocyanates, and dibasic acids can be added to the resin particles as a curing promoter. The latent curing agent is stable at room temperature, and crosslinks with a thermosetting resin in a range of 140 to 200° C. Therefore, when the latent curing agent is comprised of the resin particles, the pot life of the powder coatings is never shortened. Simultaneously, when the resin particles are formed by melting and kneading, a crosslinking reaction does not occur in a kneader. Therefore, the aforementioned problems such as a deterioration of a productivity, of a smoothness of a coating, etc. does not arise.

If necessary, it is possible to add an additive or a function material to the resin particles, such as a filler such as calcium carbonate, barium sulfate, talc; a thickener such as silica, alumina, aluminum hydroxide; a pigment such as titanium oxide, carbon black, iron oxide, copper phthalocyanine, azo pigments, condensed polycyclic pigments; a flowing agent such as silicone, acrylic oligomer such as butyl polyacrylate; a foam inhibitor such as benzoin; an accelerating agent such as zinc compounds; a wax such as polyolefine; a coupling agent such as silane coupling; an antioxidant; a magnetic powder; a metal powder; an antimicrobial agent; etc.

The particles comprising a curing agent according to the present invention comprise a well known solid curing agent commonly used for powder coatings such as dicyandiamides, imidazols, imidazolines, hydrazines, acid anhydrides, dibasic acids, polyisocyanates, tetramethoxymethyl glycol and the like. These well known solid curing agents can be used alone or combined together with two or more kinds. In particular, when the resin particles comprise a thermosetting resin having epoxy group, it is preferable to use the curing agent curing at low temperature, for example, 120° C. or less, such as imidazoles, epoxy resin amine adduct type curing agent comprising aromatic amines, or aliphatic amines, and epoxy resins. Because the functional group of the thermosetting resin and the functional group of the curing agent can rapidly crosslink, and the obtained powder coatings can be cured at low temperature.

Similarly to the resin particles, any additives can be added to the curing particles, if necessary.

It is preferable that a flow-softening temperature of the powder coatings of the present invention is in a range of 60 to 110° C. When the flow-softening temperature is less than 60° C., a caking easily occurs, and the storage properties thereof worsen. When the flow-softening temperature is more than 110° C., a flowing property of the powder coatings heated at lower temperature, specifically approximately 120° C. or less, is insufficient. Therefore, surface irregularities of the coating after heating become large, and a smoothness thereof deteriorates.

Moreover, in the present Specification, "flow-softening temperature" means the temperature measured under the following conditions:

| | |
|---|---|
| Using Flow-tester: | marketed by Shimazu Seisakujyo Co. Ltd. trade name threof is CFT-500 |
| Plunger size area: | 1.000 cm |
| Die size diameter: | 0.99 mm |
| length: | 1.00 mm |
| Load: | 20 kgF |
| programming rate: | 6.0° C./ min |

In addition, it is preferable that the powder coatings of the present invention are the aforementioned low temperature curing type. "Low temperature curing type powder coatings" means that the powder coatings in which the thermosetting resin and the curing agent are crosslinked at approximately 120° C. or less. More specifically, the low temperature curing type powder coatings are put into a differential scanning calorimeter (DSC) under the conditions wherein a programming rate is 10° C./min, an exothermal reaction is found to occur at 110° C., and an exoergic peak is 140° C. or less.

For example, the powder coatings of the present invention can be obtained by sufficiently dry blending a composition for forming the resin particle using a mixer or a blender; melting and kneading using a kneader, and cooling. Then, the obtained cooled material are coarsely crushed using a mechanical type crusher or an aerial current type crusher. The curing particles are added to the coarsely crushed particles, and sufficiently dry mixed using a mixer or a blender. The powder coatings can be obtained by coarsely crushing the mixed material using a mechanical type crusher or an aerial current type crusher, and classifying.

In addition, the curing particles can also be added by individually crushing the materials in pieces so as to obtain the resin particles and the curing particles, and sufficiently dry mixing the obtained resin particles and the curing particles using a mixer or a blender.

Moreover, the resin particles can be obtained by a spray dry method, and a polymerizing method.

It is preferable that a volume average particle diameter of the coating particles of the present invention is 30 μm or less. When the volume average particle diameter is more than 30 μm, the functional group of the thermosetting resin comprising the melted resin particles in heating step cannot make sufficient contact with the functional group of the curing agent comprising the curing particles; therefore, these functional groups cannot be sufficiently crosslinked. Consequently, the crosslinking density is insufficient, and the mechanical strength and the anti-solvent properties of the cured coating obtained after heat treatment decrease. In addition, when the volume average particle diameter is 30 μm or more, the surface irregularities of the coating particle layer formed on the material to be coated are larger; therefore, the smoothness of the cured coating obtained after heat treatment decreases. In particular, the volume average particle diameter of the coating particles of the present invention more preferably is 20 μm or less, and most preferably is 10 μm or less.

Regarding the particle diameter distribution of the coating particles of the present invention, it is preferable that the ratio of the particles having a large volume particle diameter is small, for the same reasons as above. The volume 90% particle diameter is preferably 45 μm or less, more preferably 40 μm or less, most preferably 35 μm or less. The particle diameter and the particle diameter distribution can be measured using a laser diffraction particle size distribution analyzer.

Moreover, in order to improve the flowing properties and the storage properties of the powder coatings of the present invention, and to improve the distribution between the resin particles and the curing particles in the dry mixing step, a plasticizer or a flowing agent can be added, such as an inorganic fine particle such as silica fine particles, alumina fine particles, titanium dioxide fine particles; a fine particle comprising a crosslinked resin such as methyl methacrylate; a metallic soap such as zinc stearate, lithium laurate, and the like.

The plasticizer can be made to adhere to the powder coatings of the present invention by sufficiently dry mixing the powder coatings and the plasticizer using a blender or a mixer. In this case, "adhere" means that not only the states in which the plasticizer is simply attached to the surface of the powder coatings, but also the states in which the plasticizer particles are adsorbed into the powder coatings.

Moreover, an additives can be added to the powder coatings of the present invention by dry mixing. Examples of the additives include, a metallic particle such as aluminum powder, titanium powder, copper powder, nickel powder, stainless powder; a pigment such as titanium oxide, carbon black, iron oxide, copper phthalocyanine, azo pigments, condensed polycyclic pigments; a curing catalyst such as tin compounds; a particle comprised of a thermosetting resin such as polyamide resin, polyurethane resin; an antimicrobial agent such as silver complexes; an antioxidant; an ultraviolet ray absorbent agent; and the like.

The powder coatings obtained in the above methods of the present invention comprise the resin particles comprising a thermosetting resin, and the particles containing a curing agent. When the powder coatings are in a powder state, that is a solid state, the possibility of making contact between the thermosetting resin and the curing agent is very small. Therefore, though the powder coatings belong to a powder coating which cures at low temperature, their storage properties such as a pot life do not worsen, and the productivity thereof is excellent.

DETAILED DESCRIPTION OF THE PREFERRED EXAMPLES

Example 1

| 1. Formation of the powder coatings | |
|---|---|
| epoxy resin (marketed by Tohto Kasei Co. Ltd.; trade name: YD-012) | 94.5 weight % |
| flowing agent (butyl polyacrylate) | 1.0 weight % |
| antifoaming agent (benzoin) | 0.5 weight % |
| pigment (carbon black) | 4.0 weight % |

The mixture of the above-described composition was mixed by the SUPER MIXER, melted and kneaded at 110° C. by a kneader, cooled, and then coarsely crushed by a mechanical crusher to be approximately 1 to 3 mm of a particle diameter. The obtained particles and the curing agent which cure at low temperature (imidazole; marketed by Shikoku Kasei Co., Ltd.; trade name: $C_{11}Z$) were dry mixed at weight ratio of 93:7 using a mixer. Then, the obtained mixture was crushed using an aerial current type crusher so as to obtain fine particles. The powder coatings A were obtained by removing the particles having a larger diameter using an aerial current type classifier.

The obtained powder coatings A had an exothermal reaction occuring at 110° C., an exoergic peak at 121° C., a flow-softening temperature at 74° C., an average volume particle diameter of 8 μm, and a volume 90% particle diameter of 16 μm.

2. The Material to be Coated

The materials A and B to be coated were used.

The material A to be coated was obtained by making the adhesive sheet (marketed by Rintex Co., Ltd.; trade name: Adwill C) adhere onto the back face of the polyimide film (marketed by Ube Kosan Co. Ltd.; trade name: Upilex,; thickness: 125 μm), and cut to a 50 mm×50 mm size. The material B to be coated was obtained by cutting an iron plate treated with zinc sulfate (marketed by Nippon Panel Co., Ltd.; trade name: PB-137M) to a 70 mm×50 mm size.

3. Cleaning the Material to be Coated and Formation of the Adhesive Layer

The adhesive was obtained by mixing epoxy resin in a liquid state (marketed by Tohto Kasei Co. Ltd.; trade name: YD-128) and the curing agent (imidazole; marketed by Shikoku Kasei Co., Ltd.; trade name: $C_{11}Z$) at weight ratio of 95:5, and diluting with acetone to 5%.

The adhesive layers were formed on the materials A and B to be coated by dipping the materials A and B to be coated into the obtained adhesive (the material to be coated was simultaneously cleaned) and drying using a hot air from a dryer for 30 seconds.

4. Coating Apparatus

The coating apparatus having a same structure as shown in FIG. 1 was used. Moreover, the volume of container 1 is 2.8 liter, and the depth thereof is 150 mm.

5. Formation of a Coating 1200 cc of the impact medium having a diameter of 1.0 mm and which were obtained by coating ceramics globe having a diameter of 0.8 mm with urethane rubber, and 30 g of the obtained powder coatings A were put into the container 1. Then, the container 1 was vibrated for 5 minutes, thereby the powder coatings A and the impact medium were uniformly mixed. After that, the formation of a coating was carried out by feeding the material A to be coated into the container 1, and vibrating the container 1 for 90 seconds. Then, the material A was taken out from the container 1, heated for 60 minutes at 80° C. in a dryer, and thereby the cured coating was obtained. The material A that formed the cured coating on one surface thereof of the present example was obtained by cooling down the material to be coated to room temperature, the adhesive sheet was peeled from the back surface of the material.

Moreover, the material B formed the cured coating on one surface thereof was similarly obtained.

Example 2

| 1. Formation of the powder coatings | |
|---|---|
| epoxy resin (marketed by Tohto Kasei Co. Ltd.; trade name: ST-5080) | 94.5 weight % |
| flowing agent (butyl polyacrylate) | 1.0 weight % |
| antifoaming agent (benzoin) | 0.5 weight % |
| pigment (carbon black) | 4.0 weight % |

The mixture of the above-described composition was mixed by the SUPER MIXER, melted and kneaded at 110° C. by a kneader, cooled, and then coarsely crushed by a mechanical crusher to be approximately 1 to 3 mm of a particle diameter, and the particles having a smaller diameter and the particles having a larger diameter were removed using an aerial current type classifier. The obtained particles and the curing agent which cure at low temperature having an average volume particle diameter of 3 μm (epoxy resin amine adduct type curing agents; marketed by Shikoku Kasei Co., Ltd.; trade name: Cureduct P-0505) were dry mixed at weight ratio of 80:20 using a mixer. Then, 100 weight parts of the obtained mixture and 0.3 weight parts of silica fine particles (marketed by Nippon Airozil Co., Ltd.; trade name: Aerozil 200) were sufficiently dry mixed using a mixer, thereby the powder coatings B was obtained.

The obtained powder coatings B had an exothermal reaction at 110° C., an exoergic peak at 119° C., a flow-softening temperature at 80° C., an average volume particle diameter of 23 μm, a fluidity of 0.42, and a volume 90% particle diameter of 35 μm.

2. The Material to be Coated

The materials A and B to be coated were the same as used in Example 1.

3. Cleaning the Material to be Coated and Formation of the Adhesive Layer

The cleaning the material to be coated and formation of the adhesive layer were carried out in the same way as in Example 1, except that epoxy resin in a liquid state (marketed by Tohto Kasei Co. Ltd.; trade name: ST-3000) was used instead of epoxy resin in a liquid state (marketed by Tohto Kasei Co. Ltd.; trade name: YD-128).

4. Coating Apparatus

The coating apparatus was the same as used in Example 1.

5. Formation of a Coating 800 g of the obtained powder coatings B were put into the container 1, and the material A to be coated was input into the container 1. The coating was formed by vibrating the container 1 for 90 seconds. After that, the material A to be coated was taken out from the container 1, and was heated for 30 minutes at 100° C. in a dryer, and thereby the cured coating was obtained. The material A formed the cured coating on one surface of the present example was obtained by cooling down the material to be coated to room temperature and the adhesive sheet was peeled from the back surface of the material.

Moreover, the material B formed the cured coating on one surface was similarly obtained.

Comparative Example 1

| 1. Formation of the powder coatings | |
|---|---|
| epoxy resin (marketed by Tohto Kasei Co. Ltd.; trade name: YD-012) | 89.5 weight % |
| curing agent (imidazole; marketed by Shikoku Kasei Co., Ltd.; trade name: $C_{11}Z$) | 5.0 weight % |
| flowing agent (butyl polyacrylate) | 1.0 weight % |
| antifoaming agent (benzoin) | 0.5 weight % |
| pigment (carbon black) | 4.0 weight % |

The mixture of the above-described composition was mixed by the SUPER MIXER, melted and kneaded at 110° C. by a kneader, cooled, and then coarsely crushed by a mechanical crusher to an approximately 1 to 3 mm particle diameter. The obtained particles were further crushed using an aerial current type crusher. The powder coatings C were obtained by removing the particles having a larger diameter using an aerial current type classifier.

The obtained powder coatings C had an exothermal reaction at 110° C., an exoergic peak at 118° C., a flow-softening temperature at 98° C., and an average volume particle diameter of 15 μm.

In forming the powder coatings, the kneading of the thermosetting resin and the curing agent started under the condition of the amount discharged is 20 kg/hr. However, the cured material comprising the thermosetting resin and the curing agent adhered to the groove formed in the kneader shaft. Then, the materials for powder coatings are slightly stirred by the kneader, and the amount discharged was decreased to 11 kg/hr. In addition, it required a great deal of labor to remove the cured material from the groove and clean up after kneading. When the powder coatings curing at low temperature were obtained by this method, the productivity thereof was low. Therefore, the industrial large-scale production of the powder coatings curing at low temperature in this methods is impossible.

2. The Material to be Coated

The materials A and B to be coated were the same as used in Example 1.

3. Cleaning the Material to be Coated and Formation of the Adhesive Layer

The cleaning the materials A and B to be coated and formation of the adhesive layer was carried out in the same way as in Example 1.

4. Coating Apparatus

The coating apparatus was the same as used in Example 1.

5. Formation of a Coating

The formation of a coating was carried out using the materials A and B in the same way as in Example 1.

The flow-softening temperature, the average volume particle diameter, the storage properties, and the productivity of the obtained powder particles A to C were measured in accordance with the following methods.

Flow-softening Temperature

The flow-softening temperature was measured using a Flow Tester (marketed by Shimazu Seisakujyo Co. Ltd.; trade name: CFT-500) under the aforementioned conditions.

Average Volume Particle Diameter

The average volume particle diameter was measured using a laser diffraction particle size distribution analyzer.

Storage Properties

Anti-blocking Properties 50 g of the obtained powder coatings were put into a polyethylene vessel having 200 cc capacity, and the vessel was put into a thermostat controlled chamber at a temperature of 30° C., a humidity of 60 RH, and maintained under these conditions for 30 days. After the vessel was maintained at room temperature for 3 hours, the powder coatings were taken out the vessel, and the degree of a blocking was evaluated by visual inspection and touch.

The evaluation degrees are as follows:

○ indicates that the blocking was not confirmed, and

× indicates that the blocking was confirmed.

Pot Life

The periods of a gel time were measured.

The evaluation degrees are as follows:

○ indicates that the gel time is 50% or more against the gel time before a leave, and × indicates that the gel time is less than 50% or more against the gel time before a leave.

Moreover, the "gel time" was the period measured by adding a proper quantity of the obtained powder coatings into the sample cell in which the temperature was kept at 100° C., using a gelation tester (marketed by Nisshin Kagaku Co. Ltd.), confirming whether or not the powder coatings were in a gel state at 1 minute intervals using a needle. The gel time is the time when the melt coating particles no longer from ribbons when drawn.

Productivity

The amount discharged at the starting of melting and kneading and after 30 minutes were measured.

The evaluation degrees are as follows:

○ indicates that the decrease of the amount discharged was not confirmed, and

× indicates that the decrease of the amount discharged was confirmed.

In addition, the coating thickness, the smoothness, the mechanical strength, and the anti-solvent property regarding the obtained cured coating were evaluated in accordance with the following methods.

Moreover, when the coating thickness, and the smoothness were measured, the material A formed the cured the coating on one surface thereof was used. When the mechanical strength, and the anti-solvent property were measured, the material B formed the cured the coating on one surface thereof was used.

The Coating Thickness

The coating thickness was measured at 5 points per 1 coating using a micrometer. The average value of the 5 values was defined as the coating thickness.

Smoothness

The smoothness of the obtained cured coatings was evaluated by visual inspection The evaluation degrees are as follows:

○ indicates that the cured coatings have a sufficient smoothness, and

× indicates that the existence of defects such as an orange peel and irregularities were confirmed.

Mechanical Strength

The elasticity was evaluated in accordance with JIS K 5400.6.15.

The evaluation degrees are as follows:

○ indicates that the crack does not occur when the obtained cured coating was bent using a stick having a diameter of 4 mm, and × indicates that the crack occurs when the obtained cured coating was bent using a stick having a diameter of 4 mm.

Anti-solvent Property

The surface of the obtained cured coating was rubbed back and forth 50 times using a cloth permeated xylol at 300 g/cm$^2$. After that, the existences of defects such as color change, cracks, expanding, and swelling were confirmed.

The evaluation degrees are as follows:

○ indicates that a defect was not confirmed, and

× indicates that a defect was confirmed.

The results of these tests are shown in Table 1 below.

TABLE 1

| | Example 1 | Example 2 | Comparative Example 1 |
|---|---|---|---|
| The obtained powder coatings | A | B | C |
| Flow-softening temperature (° C.) | 73 | 80 | 98 |
| Average volume particle diameter (μm) | 8 | 23 | 15 |
| Anti-blocking properties | ○ | ○ | ○ |
| Pot life | ○ | ○ | X |
| Productivity | ○ | ○ | X |
| Coating thickness (μm) | 28 | 34 | 29 |
| Smoothness | ○ | ○ | X |
| Mechanical strength | ○ | ○ | ○ |
| Anti-solvent property | ○ | ○ | ○ |

As shown in Table 1, the powder coatings A and B have excellent storage properties and productivity; however, the pot life and the productivity of the powder coating C were inferior.

The cured coatings obtained in Examples 1 and 2 have excellent smoothness, mechanical strength, and anti-solvent property; however, the smoothness of the cured coating obtained in Comparative Example 1 was inferior.

What is claimed is:

1. A method for forming a coating on a material comprising the steps of making a powder coating composition comprised of resin particles consisting essentially of thermosetting resin and particles containing a curing agent, adhering said composition to an adhesive layer previously formed on the surface of a material to be coated, and heating the coated particles, wherein the thermosetting resin is selected from the group consisting of epoxy, acrylic, phenolic, polyester or mixtures thereof and the curing agent is selected from the group consisting of a dicyandiamide, an imidazoline, an hydrazine, an acid anhydride, an isocyanate, a dibasic acid, an imidazole, a glycol, an amine, an epoxy resin-amine adduct and mixtures thereof.

* * * * *